United States Patent [19]

Leitner, Sr.

[11] Patent Number: 4,788,756

[45] Date of Patent: Dec. 6, 1988

[54] APPARATUS FOR STRAIGHTENING BOW IN FABRIC IN A TENTER FRAME

[76] Inventor: Frank W. Leitner, Sr., 5700 Providence Lake Ln., Matthews, N.C. 28105

[21] Appl. No.: 5,963

[22] Filed: Jan. 22, 1987

[51] Int. Cl.[4] ..... D06H 3/12

[52] U.S. Cl. ..... 26/51.4

[58] Field of Search ..... 26/51.3, 51.4, 51.5, 26/74, 52, 86

[56] References Cited

U.S. PATENT DOCUMENTS

| | | | |
|---|---|---|---|
| 2,311,406 | 2/1943 | Mansfield et al. | 26/51.5 |
| 2,339,204 | 1/1944 | Stockbarger et al. . | |
| 2,482,270 | 9/1949 | Grundy . | |
| 2,492,737 | 12/1949 | Dunn | 26/51.5 |
| 2,946,087 | 7/1960 | Haroldson et al. . | |
| 2,968,856 | 1/1961 | Allen | 26/51.5 |
| 3,167,843 | 2/1965 | Robertson et al. | 26/74 |
| 3,192,595 | 7/1965 | Morton et al. . | |
| 3,402,443 | 9/1968 | Leitner et al. . | |
| 3,436,796 | 4/1969 | Coates | 26/51.3 X |
| 3,604,078 | 9/1971 | Sciola et al. . | |
| 3,610,496 | 10/1971 | Parker . | |
| 3,636,598 | 1/1972 | Hannaway | 26/51.4 |
| 3,751,774 | 8/1973 | Hannaway | 26/51.4 |
| 3,839,767 | 10/1974 | Leitner et al. | 26/51.4 |
| 3,986,013 | 10/1976 | Brunette | 26/86 X |
| 4,305,184 | 12/1981 | Woythal . | |
| 4,346,621 | 8/1982 | Griffin . | |
| 4,360,137 | 11/1982 | Noe et al. . | |

FOREIGN PATENT DOCUMENTS

| | | | |
|---|---|---|---|
| 2757955 | 7/1979 | Fed. Rep. of Germany | 26/86 |

OTHER PUBLICATIONS

Mount Hope Data, "Application of Mount Hope Weft Stabilizer to Tenter Frames". MHTDB—WSTF Ingalls 10/76.

*Primary Examiner*—Robert R. Mackey

*Attorney, Agent, or Firm*—Bell, Seltzer, Park & Gibson

[57] ABSTRACT

An apparatus and method for correcting the bow distortions in a fabric web during a tentering operation is disclosed, and which includes a tension applying means at each of the entry and exit ends of the tenter frame, and such that a tension is applied at each of the respective opposite ends of the tenter, with the applied tensions being directed in opposite directions. A sensor is provided for detecting either a leading or a trailing bow in the advancing web, and a control system is provided which acts in response to a signal from the sensor to change the tension applied at one or both ends of the tenter frame and thereby straighten the bow.

9 Claims, 3 Drawing Sheets

APPARATUS FOR STRAIGHTENING BOW IN FABRIC IN A TENTER FRAME

The present invention relates to an apparatus and method for treating a textile fabric web in a tenter frame, and more particularly, to an apparatus and method for advancing a fabric web through a tenter frame, while avoiding the formation of undesirable lateral bows.

Conventional tenter frames are usually designed to dry and stretch a fabric web to its finished width, and comprise a pair of laterally spaced, elongate and longitudinally movable first and second chains which grip the selvages or edges of the fabric web, and advance the web through a heating chamber. The chains slightly diverge during their advance through the heating chamber, and so as to apply lateral tension to the web as it advances therethrough.

During the advance of the web through the tenter frame, the transverse rows of stitches or weft threads frequently become bowed, which is caused for example by the shrinkage of the fabric. Such bows can result in a non-uniform finished fabric, and it thus becomes necessary to subject the fabric to a straightening process following the tentering operation.

One prior attempt to control the bow in tentering operations has involved the use of curved rubber rolls at the entry end of the frame. Another prior attempt involves pulling rolls positioned between the exit end and the winder to "pull up the bow", with the pulling rolls being driven by a positively infinitely variable mechanical transmission. In still another approach, a roll type feed system is positioned at the entry end of the tenter frame, with the feed system being operated to deliver the fabric web to the tenter with the center of the web advanced with respect to the selvages, so that there will be no bow in the web at the exit end. However, the manual or automatic control of these various corrective systems is very difficult, and they usually require an operator at each of the ends of the tenter frame.

It is accordingly an object of the present invention to provide an apparatus and method for advancing a textile fabric web through a tenter frame, and which is adapted to effectively avoid the formation of undesirable lateral bows in the advancing web.

It is a further object of the present invention to provide an apparatus and method adapted to automatically straighten either a trailing or an advancing bow in a fabric web being processed in a tenter frame, and wherein the conventional pull rolls or bow rolls may be eliminated.

These and other objects and advantages of the present invention are achieved in the embodiment illustrated herein by the provision of a tenter frame which comprises a pair of laterally spaced, elongate and longitudinally movable first and second fabric engaging means for advancing a fabric web forwardly while applying lateral tension to the web, in combination with means for correcting a laterally extending bow in the advancing web. The correcting means comprises entry and exit tension applying means positioned at respective entry and exit ends of the tenter frame for applying a longitudinal tension to the advancing sheet at each of the ends, and with the applied tensions being directed in opposite directions so as to act against each other. Also, control means are provided for selectively adjusting one or both of the entry and exit tension applying means so as to eliminate any laterally extending bow in the advancing sheet. Preferably, means are also provided for sensing a laterally extending bow in the advancing web, with the sensing means being operatively connected to the control means to permit automatic operation thereof.

Some of the objects and advantages of the invention having been stated, others will appear as the description proceeds when taken in conjunction with the accompanying drawings, in which FIG. 1 is a somewhat schematic side elevation view of an apparatus embodying the present invention;

Referring more particularly to the drawings, the present invention includes a tenter frame 10, and which includes a heating chamber 12 through which a web W of fabric sheet material is passed for the purpose of drying, heat setting, or otherwise treating the fabric. The tenter frame 10 includes a pair of elongate laterally spaced, fabric engaging tenter chains of a type well known in the art, and which include spaced pins or clips for engaging the selvages or edges of the fabric web. As illustrated, the two chains are housed in the covers 14 and 15, respectively. Also, the chains are positioned so as to slightly diverge during movement through the chamber 12 so as to impart a tension laterally across the web during its advance through the chamber. Opposing reaches of the chains may be up to sixty feet or more in length, and they are mounted on the usual supporting sprockets (not shown), which in turn are driven by an electric motor and transmission assembly 16. Further details regarding the construction of a suitable motor and transmission for the tenter chains may be obtained from prior U.S. Pat. Nos. Re. 29,267, and 4,346,621.

Figure 3:
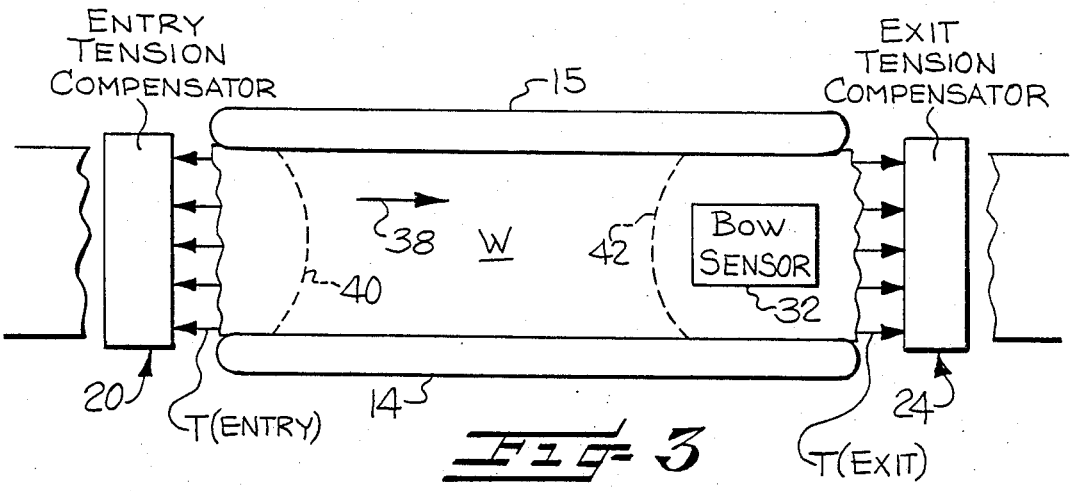
FIG. 3 is a schematic plan view of a tenter frame, and further illustrating the control means of the present invention.

The tenter frame 10 of the present invention also includes an entry tension applying means and an exit tension applying means positioned at respective opposite ends of the tenter frame. These tension applying means are adapted for applying a variable longitudinal tension to the advancing sheet at each of the ends, and with the applied tensions T (entry) and T (exit) being directed in opposite directions so as to act against each other as seen in FIG. 3.

The entry tension applying means includes a positive fabric delivery means 18 positioned adjacent the entry end of the tenter frame 10 for delivering the advancing web W while applying tension T (entry) in a direction opposite to the advancing direction. In addition, the entry tension applying means includes a tension compensator 20 positioned between the fabric delivery means 18 and the entry end of the tenter frame 10.

The exit tension applying means includes a positive fabric takeup means 22, such as a winder, positioned adjacent the exit end of the tenter frame for taking up the advancing fabric web W while applying tension T (exit) in the advancing direction. The exit tension applying means also includes an exit tension compensator 24 positioned between the tenter frame and the takeup means 22.

The entry tension compensator 20 and the exit tension compensator 24 each comprise two laterally disposed and parallel rolls 25, 26 which are longitudinally separated and fixedly mounted to the frame of the machine. In addition, a compensator roll 28 is mounted for movement with respect to the pair of rolls 25, 26 along a vertical line which perpendicularly bisects a line extending longitudinally between the axes of the pair of rolls 25, 26. In the embodiment of FIGS. 1–4, each of the compensators 20 and 24 further comprises pneumatic piston-cylinder means 29 and associated air supply 30 and valves 31, for selectively moving the compensator roll 28 along its line of movement. The web W is threaded under the roll 25, upwardly and around the roll 28, and downwardly and under the roll 26. Thus an upward movement of a compensator roll 28 will tend to increase the tension in the advancing web and will tend to pull the center of the web W away from the adjacent ends of the chains of the tenter frame, since the engagement of the web by the chains tends to preclude movement along the edges of the web.

Figure 1:
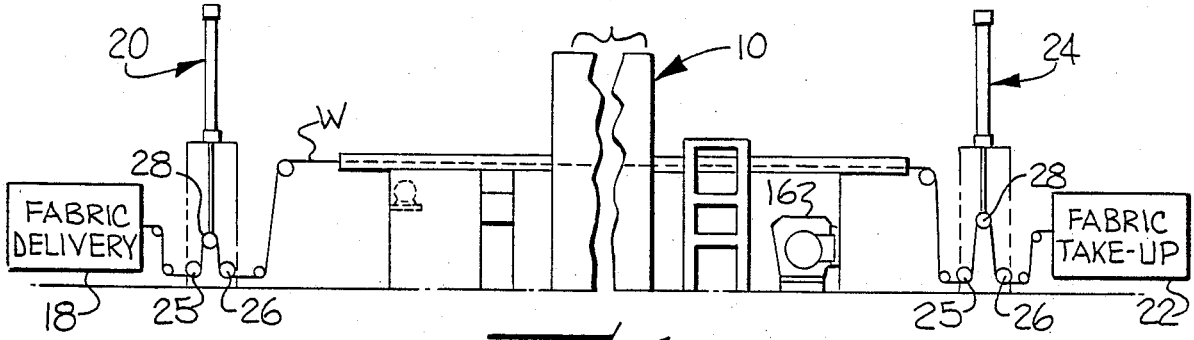
Figure 2:
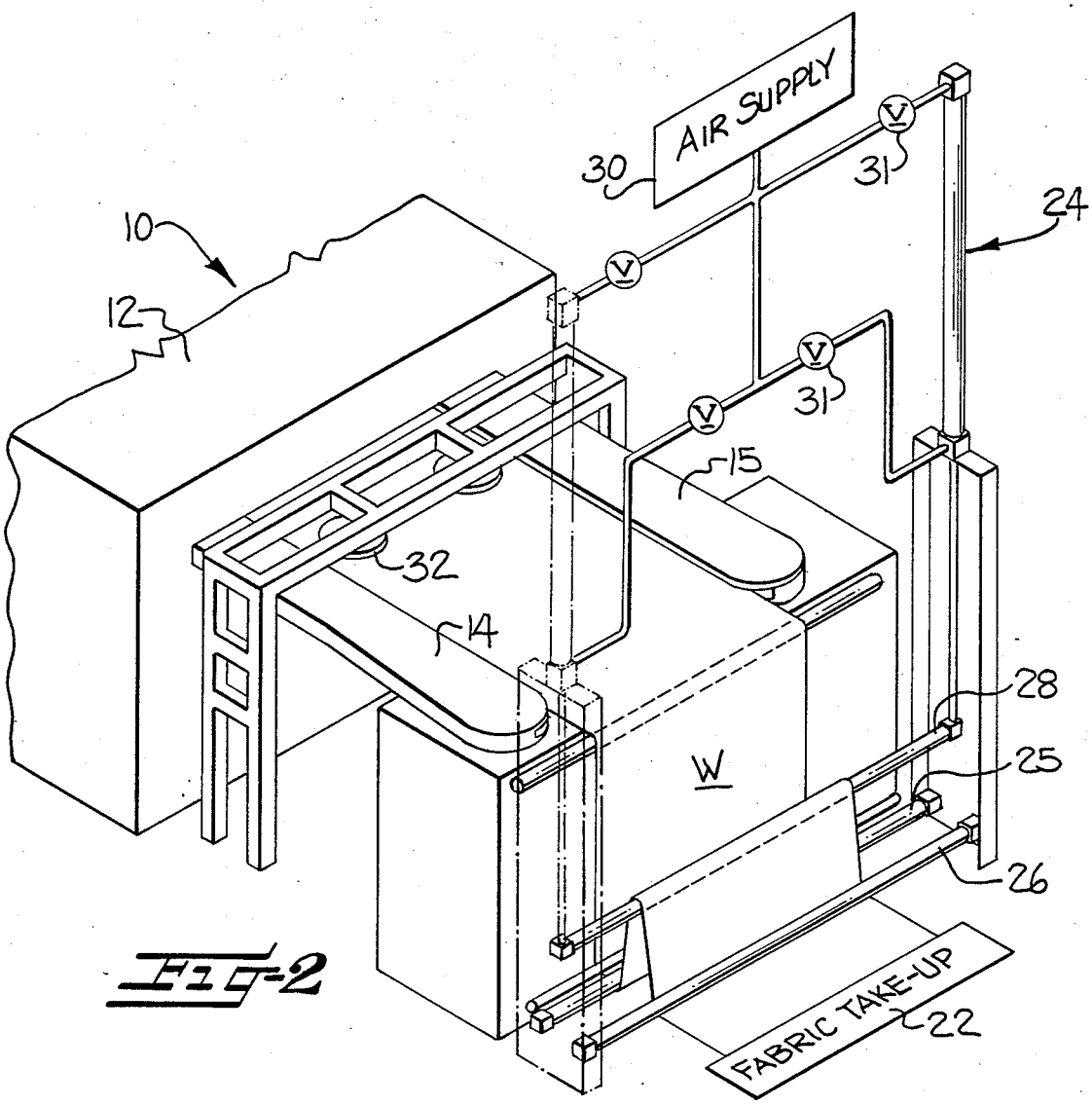
FIG. 2 is a fragmentary perspective view of the exit end of a tenter frame which embodies the features of the present invention.
Figure 4:
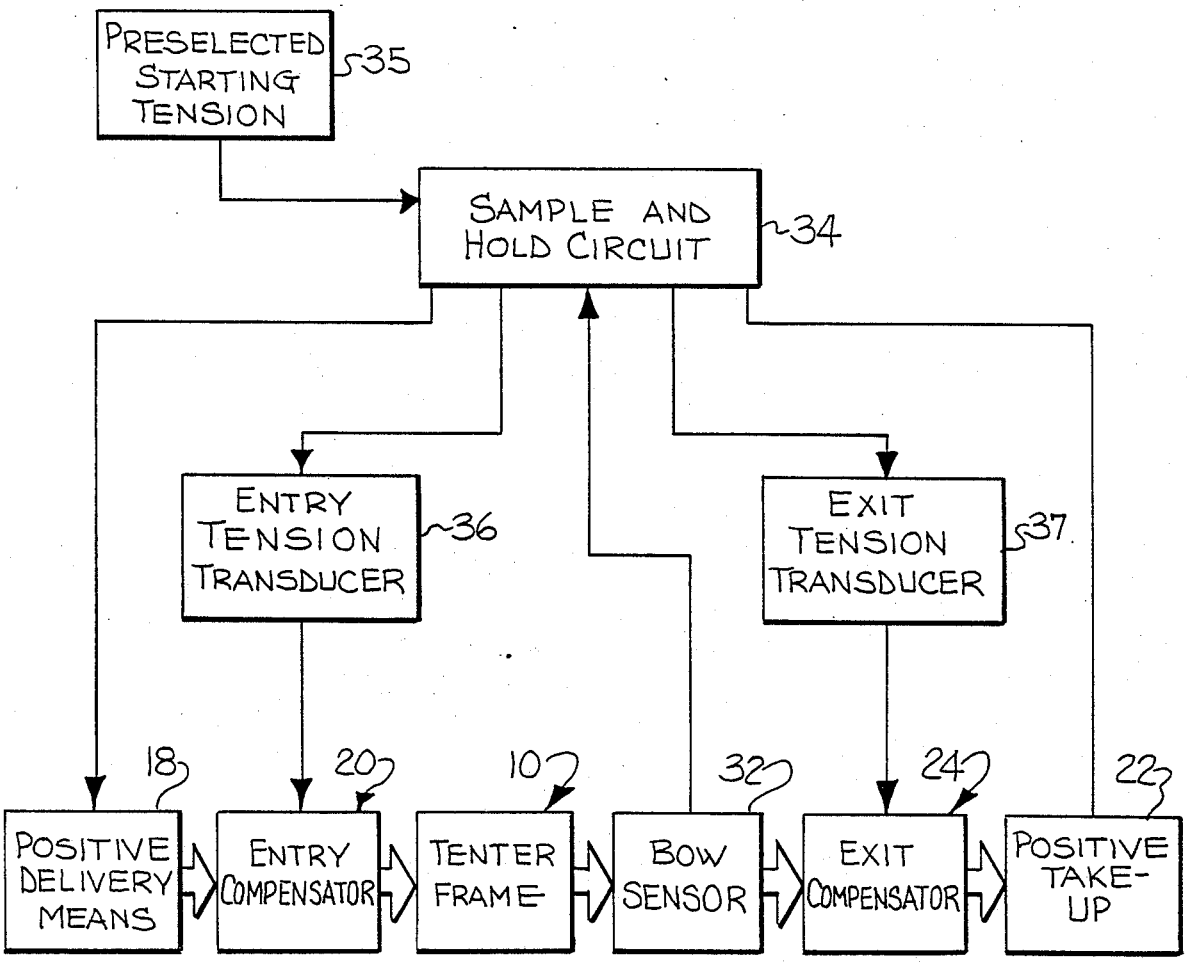
FIG. 4 is a schematic diagram of the various components of the apparatus, including the control means and bow sensing means of the present invention.

The apparatus of the present invention further includes a bow sensor 32 positioned adjacent the advancing fabric web W for sensing a laterally extending bow in the web. A bow sensor of this type is well known in the art, see for example U.S. Pat. No. Re. 29,267, and it is adapted to provide an electrical signal indicating either a forward bow or a trailing bow in the advancing fabric web. The output of the sensor 32 is connected to a control circuit 34 as schematically illustrated in FIG. 4, and the control circuit 34 includes an input control 35, whereby a desired initial tension in the fabric web may be selected, either manually or by computer control. The selected tension varies in accordance with the particular fabric and treatment, and the specific value of the initial tension is typically determined from historical experience. The control circuit 34 includes a conventional sample and hold circuit, which is adapted to periodically sample the signal from the sensor 32 and generate an ouput signal for each of two transducers 36, 37, with these output signals including an incremental change which is proportional to the deviation of the sensor signal from its norm. As best seen in FIG. 2, the transducers 36, 37 are operatively connected to the series of valves 31 in an air control system for the pneumatic piston-cylinders 29, whereby the pistons and thus the compensator roll 28 are moved up or down in accordance with the output signal from the control circuit 34.

To describe the operation of the apparatus, it will initially be assumed that the advancing fabric web W is being advanced through the tenter frame 10 in the direction of the arrow 38, and with the positive fabric delivery means 18 and the positive fabric take up means 22 applying a predetermined tension as determined by the starting tension control 35. In the event that an advancing or leading bow as indicated at 40 in FIG. 3 develops, the sensor 32 will detect the bow and it will generate an output signal which is representative of the degree and direction of the bow. The circuit 34 receives the output signal from the sensor and then generates a signal to the transducers 36, 37 which lowers the compensator roll 28 of the exit compensator 24, to thus decrease the tension across the full width of the web at the exit end. If the leading bow is of sufficient magnitude, the circuit 34 may also act to increase the tension at the entry end by lifting the compensator roll 28 of the entry compensator 20. When the bow is removed, the entry and exit compensators are held in their adjusted positions, until a further signal is received from the sensor 32.

In the event of a trailing bow as indicated at 42 in FIG. 3, the sensor 32 again detects the bow and generates a signal which is representative of the degree and direction of the bow. The circuit 34 then acts through the transducers 36, 37 to increase the tension at the exit compensator 24. Also, the tension at the entry end may be decreased where the trailing bow is of a significant magnitude.

Figure 5:
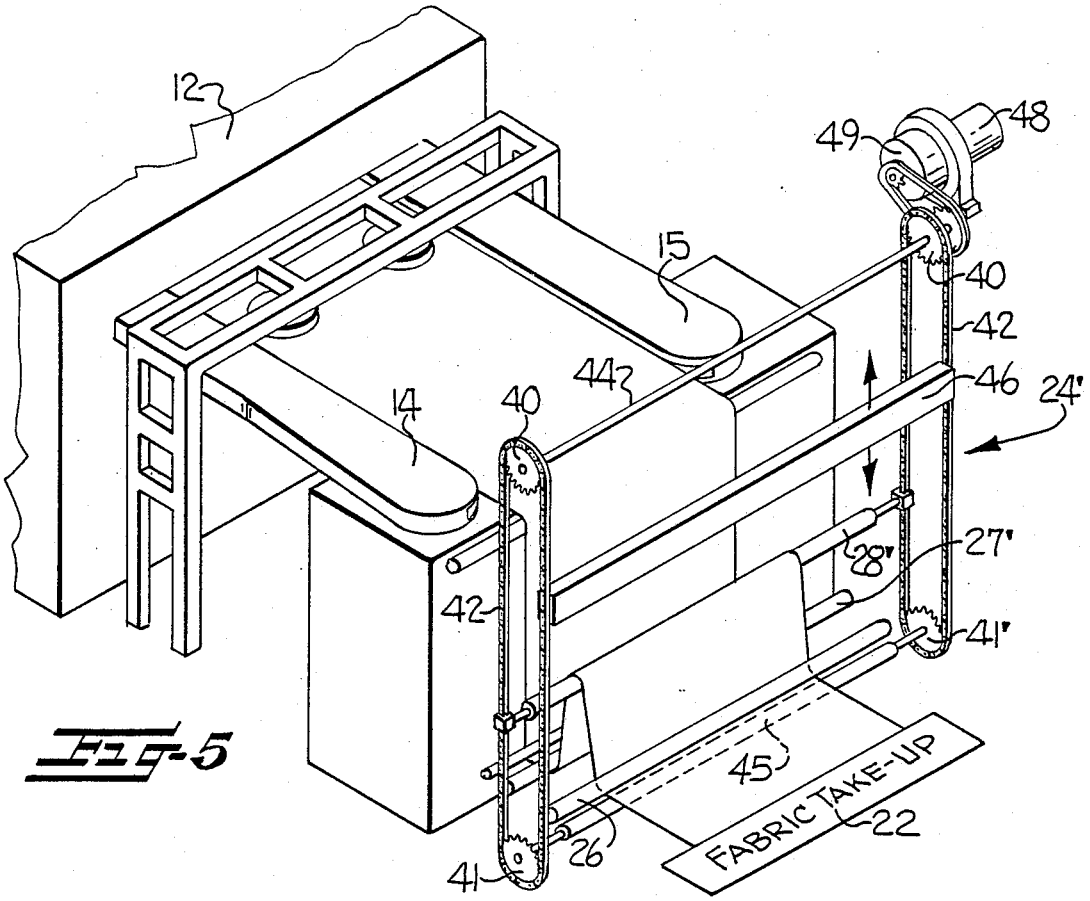
FIG. 5 is a view similar to FIG. 4, but illustrating a different embodiment of the invention.
Figure 6:
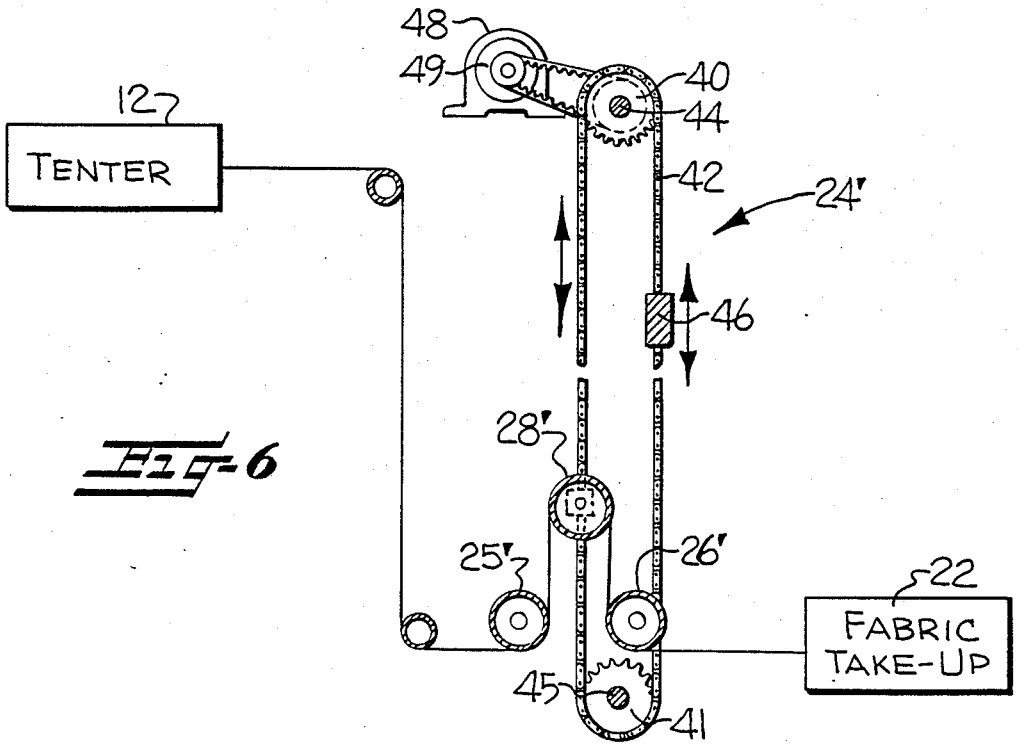
FIG. 6 is a fragmentary side elevation view of the embodiment of FIG. 5.

FIGS. 5 and 6 illustrate an alternative embodiment of the exit compensator at 24', it being understood that the entry compensator may be of like construction. The exit compensator 24' comprises parallel rolls 25', 26' which are fixedly mounted to the frame of the machine, and a vertically movable compensator roll 28'. The compensator roll 28' is mounted by means of a pair of endless belt means, each of which takes the form of a pair of sprockets 40, 41 and chain 42 in the illustrated embodiment. An upper drive shaft 44 drivingly interconnects the two upper sprockets 40, and a lower shaft 45 interconnects the two lower sprockets 41.

Each of the endless chains defines parallel vertical runs, and the compensator roll 28' is fixed to one of the runs of each chain 42. A counterbalancing weight 46 is connected to the other run of each of the chains 42. Preferably, the counterbalancing weight is slightly heavier than the weight of the roll 28', so as to provide a minimum tension in the fabric when it is threaded through the rolls 25', 26', and 28' as best seen in FIG. 6.

The vertical movement of the roll 28' is effected by an electrical motor 48, which acts through a suitable gear reducer 49 to rotate the upper drive shaft 44. The electrical motor 48 typically is a conventional three phase, reversible stalled torque motor, which is designed to produce a torque without turning. A motor of this type is presently manufactured by General Motors Corporation. Also, the motor 48 is operatively connected to the control circuit 34 of the present invention, and so that the level of the applied torque is thereby controlled.

From the above, it will be seen that the present invention is adapted to effectively eliminate either a trailing or advancing bow in a fabric web being processed in a tenter frame, and wherein the conventional pull rolls or bow rolls may be eliminated. In this regard however, it will be understood that pull rolls may also be employed with the present invention, with the pull rolls positioned between the exit end of the tenter frame and the exit compensator 24, for the purpose of assisting in withdrawing the fabric web from the chains of the tenter frame.

In the drawings and specification, there have been set forth preferred embodiments of the invention, and although specific terms are employed, they are used in a generic and descriptive sense only and not for purposes of limitation.

That which I claim is:

1. In a tenter frame comprising a pair of laterally spaced, elongate and longitudinally movable first and second fabric engaging means for advancing a fabric web forwardly while applying lateral tension thereto, the combination therewith of means of correcting a laterally extending bow in the advancing fabric web and which comprises entry and exit tension applying means positioned at respective entry and exit ends of the tenter frame for applying a variable longitudinal tension to the advancing web at each of said ends of the tenter frame, and with the applied tensions being applied in opposite directions and so as to act against each other, means for sensing a laterally extending bow in the advancing fabric, and control means operatively connected to said sensing means and to both of said entry and exit tension applying means for selectively adjusting the tension applied by one or both of said entry and exit tension applying means in response to a signal from said sensing means and so as to automatically eliminate any laterally extending bow in the advancing sheet.

2. The tenter frame as defined in claim 1 wherein said entry tension applying means includes fabric delivery means positioned adjacent the entry end of said tenter frame for delivering the advancing fabric web while applying tension in a direction opposite to the advancing direction, and wherein said exit tension applying means includes fabric takeup means positioned adjacent the exit end of said tenter frame for taking up the advancing fabric web while applying tension in the advancing direction.

3. The tenter frame as defined in claim 2 wherein said entry tension applying means further includes entry tension compensator means positioned between said fabric delivery means and the entry end of said tenter frame, and said exit tension applying means further includes exit-tension compensator means positioned between the exit end of said tenter frame and said fabric takeup means.

4. The tenter frame as defined in claim 3 wherein said entry tension compensator means and said exit tension compensator means each comprise a pair of laterally disposed and parallel rolls which are longitudinally separated and fixedly mounted with respect to each other, a compensator roll, and means mounting said compensator roll for movement with respect to said pair of rolls along a line which perpendicularly bisects a line extending longitudinally between the axes of the pair of rolls and in response to a signal from said sensing means.

5. The tenter frame as defined in claim 4 wherein each of said entry tension compensator means and said exit tension compensator means further comprises actuator means for selectively positioning the compensator roll along its line of movement with respect to said pair of rolls, and in response to a signal from said sensing means.

6. The tenter frame as defined in claim 5 wherein said actuator means comprises pneumatic piston-cylinder means connected to each end of said compensator roll, air supply means for delivering pressurized air to each end of each of said pneumatic piston-cylinder means, and valve means operatively controlled by the signal from said sensing means for controlling the delivery of the pressurized air from said air supply means to each end of each of said pneumatic piston-cylinder means.

7. The tenter frame as defined in claim 4 wherein said means mounting said compensator roll comprises a pair of endless belt means mounted adjacent respective ends of said compensator roll, with each of said belt means defining parallel runs, and with said compensator roll fixed to one of said runs of each of said belt means, shaft means drivingly interconnecting said pair of belt means, and actuator means operatively connected to said shaft means for selectively moving said pair of endless belt means and thus said compensator roll.

8. The tenter frame as defined in claim 7 further comprising a counterbalancing weight connected to each of the other runs of said pair of endless belt means.

9. The tenter frame as defined in claim 8 wherein said actuator means comprises an electrical motor.

* * * * *